73-151
10/20/81 XR SR 4,295,361

United States Patent [19]
McMahan

[11] 4,295,361
[45] Oct. 20, 1981

[54] DRILL PIPE TESTER WITH AUTOMATIC FILL-UP

[75] Inventor: Michael E. McMahan, Duncan, Okla.

[73] Assignee: Halliburton Company, Duncan, Okla.

[21] Appl. No.: 136,830

[22] Filed: Apr. 3, 1980

[51] Int. Cl.³ ..... G01M 3/08
[52] U.S. Cl. ..... 73/40.5 R; 73/151; 166/323
[58] Field of Search ..... 73/40.5 R, 151; 166/321, 323, 250, 325, 331

[56] References Cited

U.S. PATENT DOCUMENTS

| | | | |
|---|---|---|---|
| Re. 27,464 | 8/1972 | Taylor, Jr. . | |
| Re. 29,471 | 11/1977 | Giroux | 166/334 |
| 3,347,318 | 10/1967 | Barrington | 166/331 |
| 3,509,913 | 5/1970 | Lewis . | |
| 3,568,715 | 3/1971 | Taylor, Jr. | 137/613 |
| 3,667,505 | 6/1972 | Radig . | |
| 3,856,085 | 12/1974 | Holden et al. | 166/264 |
| 3,967,647 | 7/1976 | Young | 137/614.11 |
| 4,009,753 | 3/1977 | McGill et al. | 166/55.1 |
| 4,042,033 | 8/1977 | Holland et al. | 166/321 X |
| 4,064,937 | 12/1977 | Barrington | 166/162 |
| 4,116,272 | 9/1978 | Barrington | 166/340 |
| 4,197,879 | 4/1980 | Young . | |
| 4,212,355 | 7/1980 | Reardon . | |
| 4,230,185 | 10/1980 | Fredd . | |

*Primary Examiner*—Jerry W. Myracle
*Attorney, Agent, or Firm*—John H. Tregoning; James R. Duzan; Lucian Wayne Beavers

[57] ABSTRACT

A drill pipe tester valve includes a housing having a first end adapted to be connected to a well test string, which housing has a flow passage therethrough. A spherical valve member having a valve bore therethrough is disposed in the flow passage of the housing. Lugs are attached to the housing for engaging the spherical valve member and rotating the spherical valve member between open and closed positions as the spherical valve member is moved axially relative to the housing. A resilient coil compression spring is located above the spherical valve member, between the housing and the spherical valve member for automatically closing the spherical valve member when the well test string is statically positioned within a well, and for automatically opening the spherical valve member and allowing well fluid within the well to fill the well test string above the spherical valve member as the well test string is lowered into the well.

19 Claims, 7 Drawing Figures

DRILL PIPE TESTER WITH AUTOMATIC FILL-UP

The following invention relates generally to drill pipe tester valves, and more particularly, but not by way of limitation, to drill pipe tester valves designed to be used above a formation tester valve in a well test string.

During the course of drilling an oil well, one operation which is often performed is to lower a testing string into the well to test the production capabilities of the hydrocarbon producing underground formations intersected by the well. This testing is accomplished by lowering a string of pipe, commonly referred to as drill pipe, into the well with a formation tester valve attached to the lower end of the string of pipe and oriented in a closed position, and with a packer attached below the formation tester valve. This string of pipe with the attached testing equipment is generally referred to as a well test string.

Once the test string is lowered to the desired final position, the packer means is set to seal off the annulus betwen the test string and a well casing, and the formation tester valve is opened to allow the underground formation to produce through the test string.

During the lowering of the test string into the well, it is desirable to be able to pressure test the string of drill pipe periodically so as to determine whether there is any leakage at the joints between successive stands of drill pipe.

To accomplish this drill pipe pressure testing, the string of pipe is filled with a fluid and the lowering of the pipe is periodically stopped. When the lowering of the pipe is stopped, the fluid in the string of drill pipe is pressurized to determine whether there are any leaks in the drill pipe above the formation tester valve.

One particular type of formation tester valve which has been so used in the prior art is that of U.S. Pat. No. 3,856,085 to Holden et al, assigned to the assignee of the present invention. The Holden et al. apparatus includes a spherical valve member with a valve bore therethrough. The spherical valve member is rotated between open and closed positions by engagement with an eccentric lug carried on a mandrel which reciprocates in the valve housing. Similar spherical valve member constructions are shown in U.S. Pat. No. Re. 29,471 to Giroux and U.S. Pat. No. 4,116,272 to Barrington, both assigned to the assignee of the present invention.

Spherical valve members which move axially relative to the housing are shown in U.S. Pat. No. 4,064,937 to Barrington; U.S. Pat. No. 3,568,715 to Taylor, Jr.; U.S. Pat. No. Re. 27,464 to Taylor, Jr.; U.S. Pat. No. 4,009,753 to McGill, et al; and U.S. Pat. No. 3,967,647 to Young.

When utilizing a valve like that of Holden et al., as a closure valve to permit pressure testing of the drill pipe as it is lowered into the well, it is necessary to fill the interior of the drill pipe above the closure valve from the surface at the well site with a fluid which can be pressurized.

The present invention provides a drill pipe tester valve to be run in the well test string above a formation tester valve like that of Holden et al. The spherical valve member and the cooperating lug are constructed in a manner somewhat similar to the above cited references. An automatic fill-up feature has, however, been added which permits the string of pipe above the drill pipe tester valve to automatically fill up with a well fluid as the well test string is lowered into the well.

The drill pipe tester valve of the present invention has a housing having a first end adapted to be connected to the string of drill pipe, which housing has a flow passage therethrough. A spherical valve member is disposed in the flow passage of the housing. Lug means are attached to the housing for engaging the spherical valve member and rotating the spherical valve member between open and closed positions wherein the flow passage of the housing is open and closed, respectively, as the spherical valve member is moved axially relative to the housing and the lug means.

Moving means are provided for moving the spherical valve member axially relative to the housing between its said open and closed positions, which moving means includes a lower valve member seat means having a downward facing surface supportably engaged by an upward facing surface of the housing when the spherical valve member is in its said closed position. This permits downward forces exerted upon the spherical valve member in its said closed position, due to fluid pressure in the string of drill pipe above the spherical valve member, to be transmitted substantially entirely to the housing through the engagement of the downward facing surface of the lower valve seat means and the upward facing surface of the housing.

A resilient spring means is also provided for resiliently urging the spherical valve member downward relative to the housing toward its said closed position, which resilient spring means provides an automatic means for allowing the spherical valve member to be moved upward by fluid pressure from the annulus between the test string and a well casing as the test string is lowered into the well casing, thereby permitting said well fluid to pass through the spherical valve member into the string of drill pipe located above the spherical valve member as the test string is lowered into the well.

Numerous features and advantages of the present invention will be readily apparent to those skilled in the art upon a reading of the following disclosure when taken in conjunction with the accompanying drawings.

It is appropriate at this point to provide a description of the environment in which the present invention is used. During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole thus closing in the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

At other times, the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or may be for the purpose of permitting pressure testing of the test string as it is lowered into the well. As mentioned, with prior art devices like that of Holden et al. U.S. Pat. No. 3,856,085 it is generally necessary to fill the test string from the surface location of the well site.

The well testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
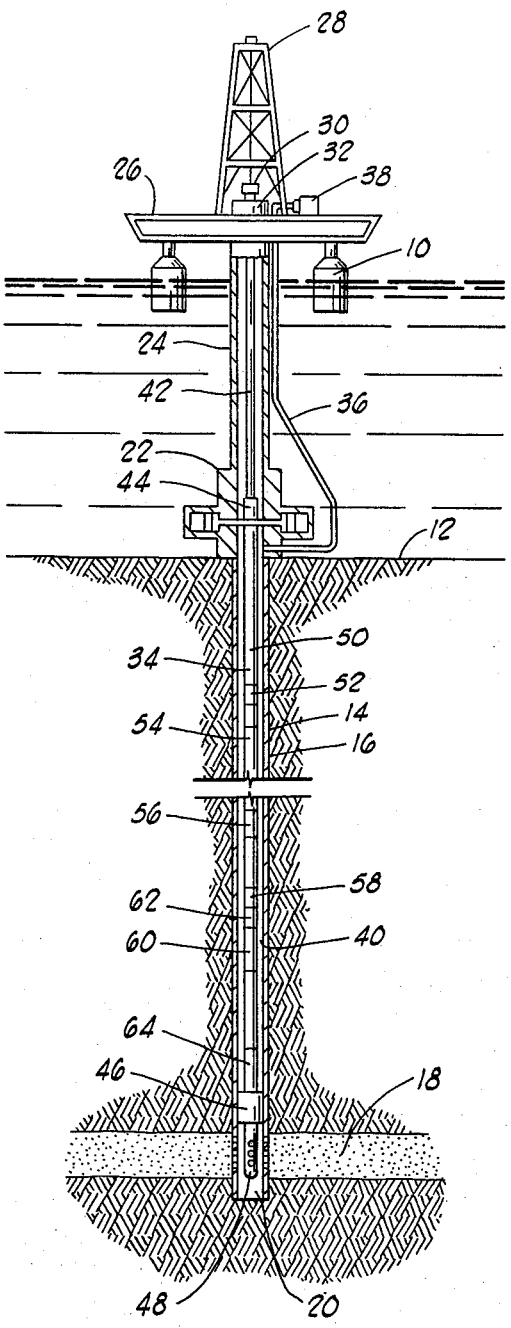
FIG. 1 shows a schematic view of a well test string in place within an offshore well.

A typical arrangement for conducting a drill stem test offshore is shown in FIG. 1. Such an arrangement would include a floating work station 10 stationed over a submerged work site 12. The well comprises a well bore 14 typically lined with a casing string 16 extending from the work site 12 to a submerged formation 18. The casing string 16 includes a plurality of perforations at its lower end which provide communication between the formation 18 and the interior of the well bore 20.

At the submerged well site 12 is located the well head installation 22 which includes blowout preventer mechanisms. A marine conductor 24 extends from the well head installation to the floating work station 10. The floating work station 10 includes a work deck 26 which supports a derrick 28. The derrick 28 supports a hoisting means 30. A well head closure 32 is provided at the upper end of marine conductor 24. The well head closure 32 allows for lowering into the marine conductor and into the well bore 14 a formation testing string 34 which is raised and lowered in the well by hoisting means 30.

A supply conduit 36 is provided which extends from a hydraulic pump 38 on the deck 26 of the floating station 10 and extends to the well head installation 22 at a point below the blowout preventor to allow the pressurizing of the well annulus 40 surrounding the test string 34.

The testing string 34 includes an upper conduit string portion 42 extending from the work site 12 to the well head installation 22. A hydraulically operated conduit string test tree 44 is located at the end of the upper conduit string 42 and is landed in the well head installation 22 to thus support the lower portion of the formation testing string. The lower portion of the formation testing string extends from the test tree 44 to the formation 18. A packer mechanism 46 isolates the formation 18 from the fluids in the well annulus 40. A perforated tail piece 48 is provided at the lower end of the testing string 34 to allow fluid communication between the formation 18 and the interior of the tubular formation testing string 34.

The lower portion of the formation testing string 34 further includes intermediate conduit portion 50 and torque transmitting pressure and volume balanced slip joint means 52. An intermediate conduit portion 54 is provided for imparting packer setting weight to the packer mechanism 46 at the lower end of the string.

It is many times desirable to place near the lower end of the testing string a conventional circulating valve 56 which may be opened by rotation or reciprocation of the testing string or a combination of both by or the dropping of a weighted bar in the interior of the testing string 10. Below circulating valve 50 there may be located a combination sampler valve section and reverse circulation valve 58, such as that shown in U.S. Pat. No. 4,064,937 to Barrington and assigned to the assignee of the present invention.

Also near the lower end of the formation testing string 34 is located formation tester valve 60 which is preferably a tester valve of the annulus pressure operated type similar to that disclosed in U.S. Pat. No. 3,856,085 to Holden et al. Immediately above the formation tester valve 60 is located the drill pipe tester valve 62 of the present invention.

A pressure recording device 64 is located below the formation tester valve 60. The pressure recording device 64 is preferably one which provides a full opening passageway through the center of the pressure recorder to provide a full opening passageway through the entire length of the formation testing string.

It may be desirable to add additional formation testing apparatus in the testing string 34. For instance, where it is feared that the testing string 34 may become stuck in the borehole 14 it is desirable to add a jar mechanism between the pressure recorder 64 and the packer assembly 46. The jar mechanism is used to impart blows to the testing string to assist in jarring a stuck testing string loose from the borehole in the event that the testing string should become stuck. Additionally, it may be desirable to add a safety joint between the jar and the packer mechanism 46. Such a safety joint would allow for the testing string 34 to be disconnected from the packer assembly 46 in the event that the jarring mechanism was unable to free a stuck formation testing string.

The location of the pressure recording device may be varied as desired. For instance, the pressure recorder may be located below the perforated tail piece 48 in a suitable pressure recorder anchor shoe running case. In addition, a second pressure recorder may be run immediately above the formation tester valve 60 to provide further date to assist in evaluating the well.

Referring now to FIGS. 2A–2E, a half-section elevation view is thereshown of the drill pipe tester valve 62 of the present invention.

The drill pipe tester valve 62 includes a housing 66 including an upper adapter 68, a first cylindrical valve casing portion 70, a middle adapter portion 72, and a second valve casing portion 74.

The upper adapter 68 and first cylindrical valve casing portion 70 may generally be referred to as an upper housing portion 76, and the middle adapter portion 72 and the second valve casing 74 may be collectively referred to as a lower housing portion 78.

An upper end 80 of lower housing portion 78 is received within a lower end 82 of upper housing portion 76, and attached thereto at threaded connection 84.

Housing 66 has an upper end 86 adapted to be connected to a string of pipe of formation testing string 34 (See FIG. 1) by means of an internally threaded connection 88. In this manner the entire weight of the portion of the test string 34 located below connection 88 is carried by the housing 66. Housing 66 has a flow passage 90 disposed axially therethrough.

Figure 2A:
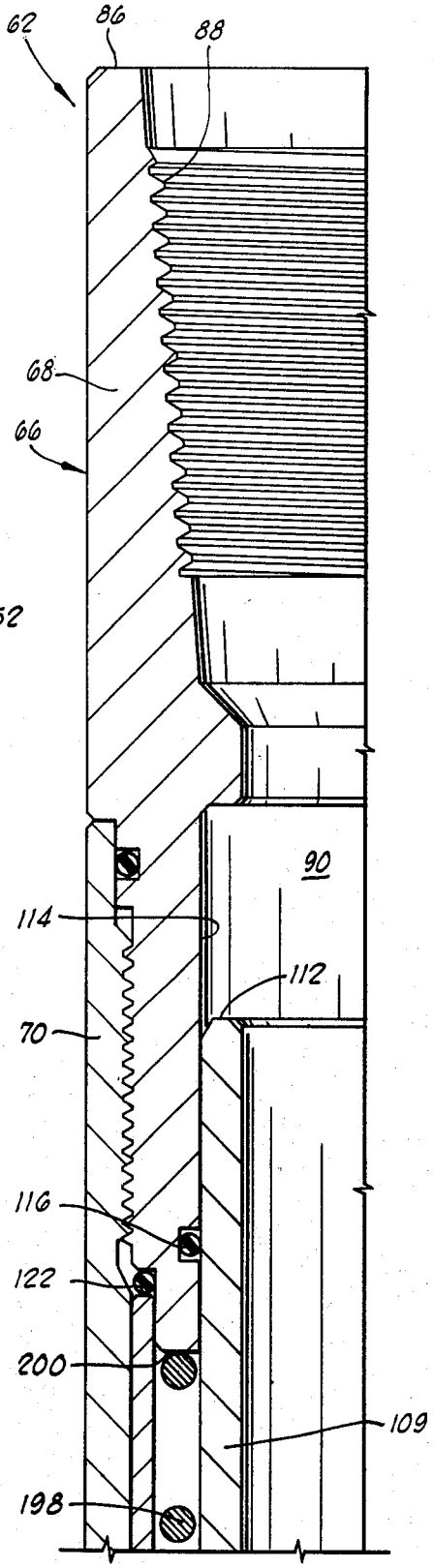
FIGS. 2A–2E show a half-section elevation view of the drill pipe tester valve of the present invention.
Figure 2B:
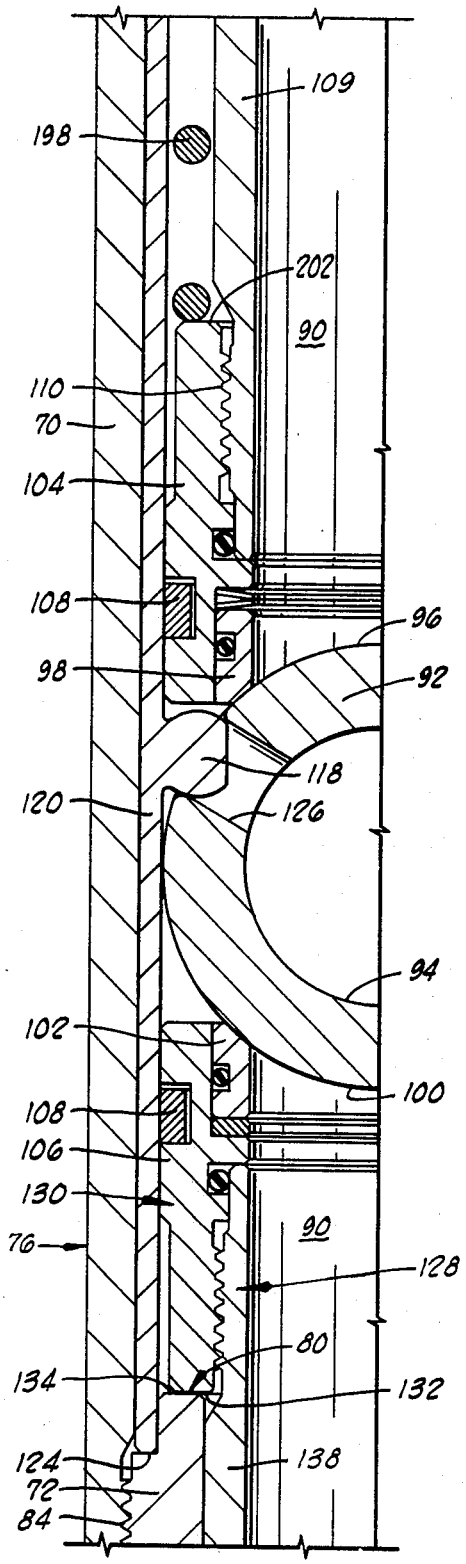
Figure 2C:
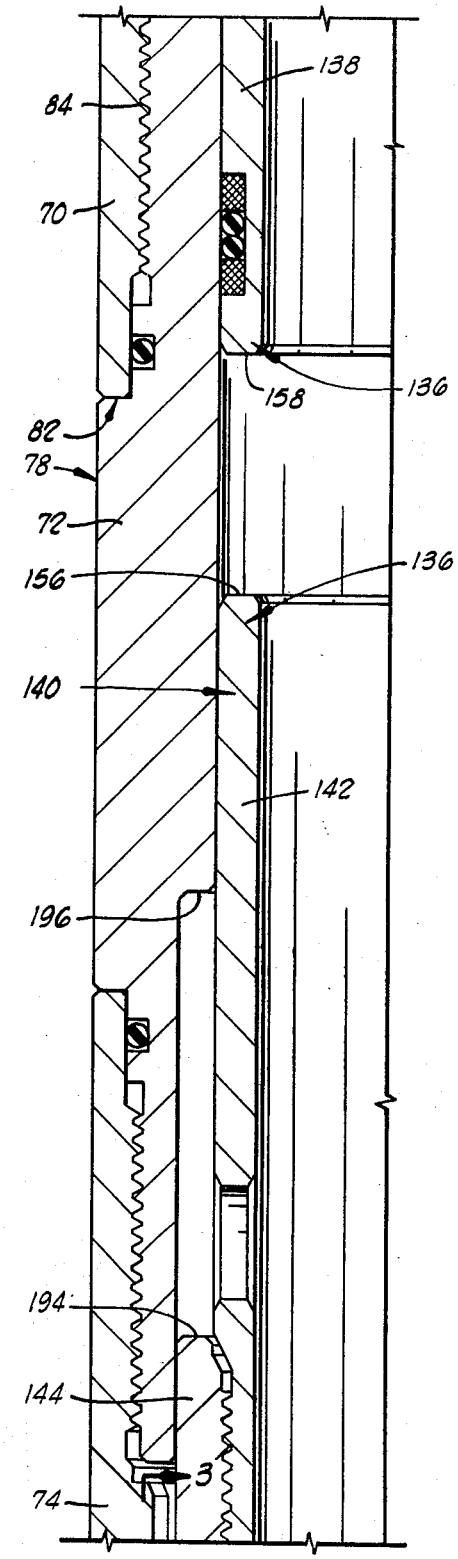
Figure 2D:
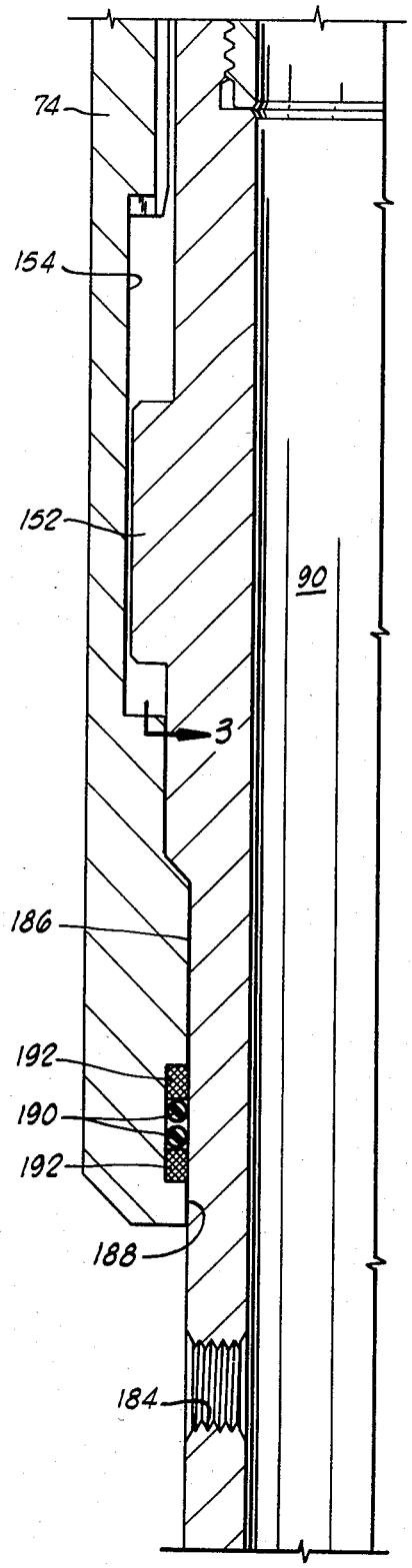
Figure 2E:
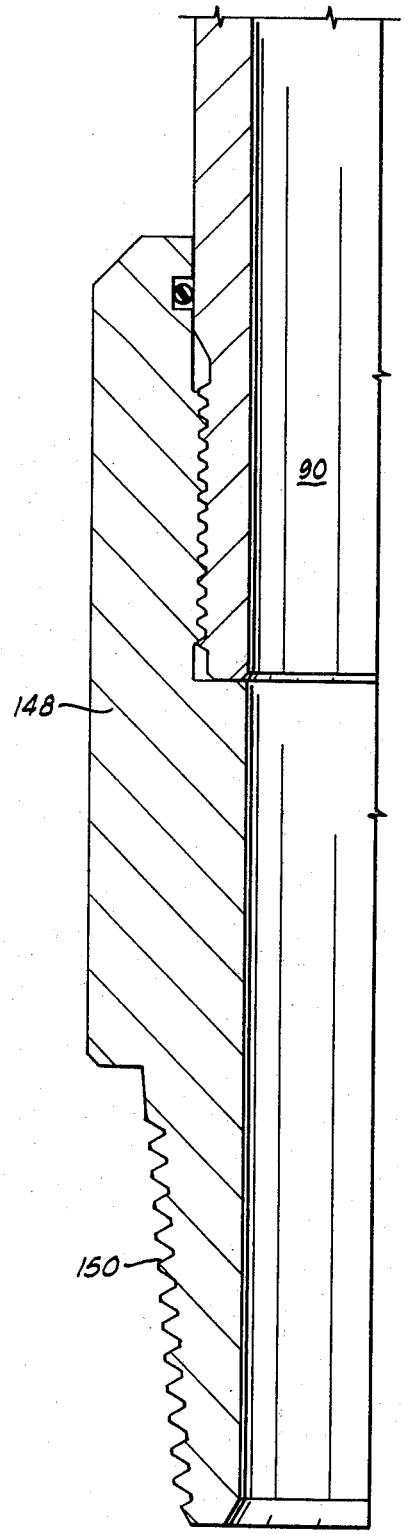

Disposed within flow passage 90 is a spherical valve member or closure valve means 92 which has a valve bore 94 therethrough. Spherical valve member 92 is shown in FIG. 2B in its closed position closing the flow passage 90.

The spherical valve member 92 has its upper surface 96 seated against an upper valve seat 98 and has its lower surface 100 seated against a lower valve seat 102.

The upper valve seat 98 is disposed in an upper valve seat carrier 104 and the lower valve seat 102 is disposed in a lower valve seat carrier 106. The upper and lower valve seat carriers 104 and 106 are connected together by a plurality of C-clamps, such as the clamp 108, two ends of which are shown in FIG. 2B. It will be understood that the C-clamp 108 is a continuous member between the two ends which are illustrated in FIG. 2B, and it therefore holds the valve seat carriers 104 and 106 together about spherical valve member 92.

A positioning mandrel or guide mandrel 109 has its lower end attached to upper valve seat carrier 104 at threaded connection 110 and has an upper end 112 closely received within cylindrical inner surface 114 of upper adapter 68. An annular seal 116 is disposed between positioning mandrel 108 and inner cylindrical surface 114.

An eccentric lug 118 is attached to a lug carrying mandrel 120 which is received within valve casing 70 and engaged at its upper and lower ends 122 and 124, respectively, by upper adapter 68 and by upper end 80 of middle adapter 72 so that eccentric lug 118 is held in a fixed position relative to housing 66.

The eccentric lug 118 engages an eccentric hole 126 disposed radially through a wall of spherical valve member 92.

A second eccentric lug (not shown) similar to lug 118 also engages another eccentric hole (not shown) of spherical valve member 92 in a manner similar to that shown in FIGS. 4A-4C of U.S. Pat. No. 3,856,085 to Holden et al., the details of which are incorporated herein by reference.

It will be appreciated that the representation of the eccentric lug 118 and mandrel 120, and of the C-clamp 108 are rather schematically shown in FIG. 2B, for purposes of convenient illustration, and that in a true sectional view of the drill pipe tester valve, both the lug 118 and the C-clamp 108 would not be shown in the same sectional view since the two are radially spaced.

When the spherical valve member 92 is moved axially relative to housing 66, in a manner which will be further described below, the engagement of lug 118 with eccentric hole 126 causes the spherical valve member 92 to be rotated relative to housing 66 between open and closed positions wherein flow passage 90 is opened and closed, respectively. The spherical valve member 92 is shown in FIG. 2B in its closed position. By movement of spherical valve member 92 axially upward relative to housing 66 from the position shown in FIG. 2B, the spherical valve member 92 is caused to be rotated toward an open position wherein the valve bore 94 is aligned with the flow passage 90 of housing 66 so as to permit flow of fluid through the flow passage 90 from one end to the other of housing 66.

Moving means generally designated by the numeral 128 are provided for moving spherical valve member 92 axially relative to housing 66. The moving means 128 may be considered as including the lower valve seat carrier 106 and the lower valve seat 102 which may be collectively referred to as a lower valve seat means 130. The lower valve seat means 130 also may be referred to in the following description as a lower valve member seat means.

The lower valve seat carrier 106 includes an annular downward facing surface 132 which is supportably engaged by an upward facing surface 134 of upper end 80 of middle adapter 72 of housing 66 when spherical valve member 92 is in its closed position as illustrated in FIG. 2B. This arrangement permits downward forces exerted upon spherical valve member 92 when in its closed position, due to fluid pressure in the test string 34 above spherical valve member 92, to be transmitted substantially entirely to housing 66 through said engagement of downward facing surface 132 and upward facing surface 134. This provides a very strong support below the spherical valve member 92 so that when the very high fluid pressures from testing of drill pipe are exerted upon the upper surface 96 of spherical valve member 92, those pressures will be transmitted directly to the housing 66.

In the disclosed embodiment the downward facing surface 132 is specifically located upon the lower valve seat carrier 106. It may, however, be generally said to be located upon the lower valve seat means 130, and it will be understood that the physical arrangement of the lower valve seat means 130 could be modified to include additional elements or to integrate seat 102 and seat carrier 106 into a single element. All that is important is that a downward facing surface, such as surface 132, be located upon a structure which structurally supports the spherical valve member 92 from below. Such structure may generally be referred to as a lower valve seat means.

The moving means 128 also includes a moving mandrel means 136 which is comprised of an upper moving mandrel portion 138 and a lower moving mandrel portion 140.

The upper moving mandrel portion 138 and an upper part of the lower moving mandrel portion 140 are reciprocably received within the lower end of housing 66 and are each reciprocable between respective upper and lower positions relative to housing 66. The upper moving mandrel portion 138 is attached to lower valve seat carrier 106 and may be said to be operably associated with lower valve seat carrier 106 so that upper and lower positions of the upper moving mandrel portion 128 correspond to upper and lower positions of the lower valve seat holder 106 relative to housing 66.

The lower position of lower valve seat holder 106 as illustrated in FIG. 2B corresponds to the closed position of spherical valve member 92 as illustrated. Upon upward movement of lower valve seat holder 106 relative to housing 66, the spherical valve member 92 is moved axially upward relative to housing 55 and is rotated to its open position as previously described by the engagement of eccentric hole 126 with eccentric lug 118.

The lower valve mandrel portion 140 includes a first uppermost section 142, a second section 146 connected to the lower end of first section 142, and a lower adapter 148 connected to the lower end of second section 146.

Lower adapter 148 includes an externally threaded lower end 150 for connection to those components of test string 34 located below drill pipe tester valve 62.

Extending radially outward from an outer surface of second section 146 of lower moving mandrel portion 140 of moving mandrel means 136 is a positioning lug 152.

Figure 3:
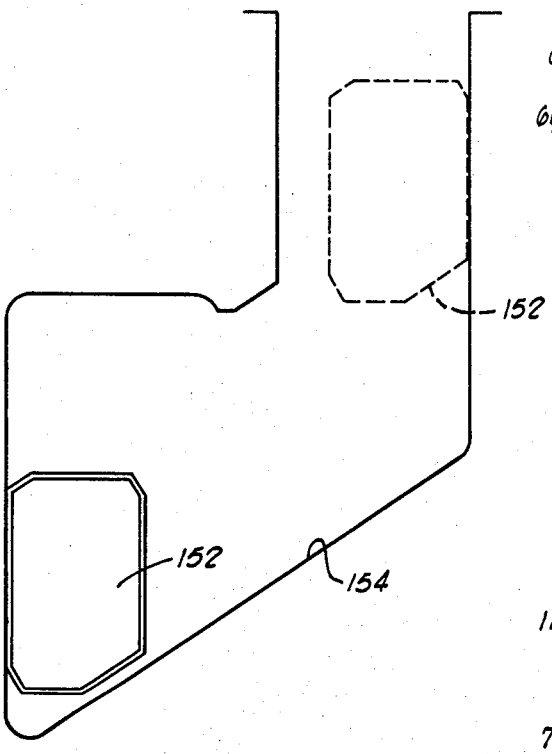
FIG. 3 shows a laid-out view of a J-slot and lug of the drill pipe tester valve of FIGS. 2A–2E.

Disposed within a radially inner surface of second valve casing portion 74 of housing 66 is a positioning slot means 154 in which positioning lug 152 is received. A laid-out view of positioning slot means 154 and positioning lug 152 is shown in FIG. 3 which is a view taken generally along line 3—3 of FIGS. 2C and 2D. The positioning slot means 154 and positioning lug 152 are so arranged and constructed that when test string 34 is rotated clockwise and a weight of testing string 34 is set down upon housing 66, the lower moving mandrel portion 140 and with it the upper moving mandrel portion 138 are moved to their upper positions relative to housing 66 thereby opening spherical valve member 92.

The position of lug 152 relative to slot 154 as the test string 34 is lowered into the well is shown in solid lines in FIG. 3. The position after test string 34 is set down is shown in phantom lines.

It will be understood by those skilled in the art that when the weight of test string 34 is set down upon housing 66, the lower moving mandrel portion 140 will not move axially relative to casing 16 of the well (see FIG. 1) because of engagement of the packer means 46 (see FIG. 1) with the casing 16.

The packer means 46 is preferably a "Halliburton RTTS" retrievable packer such as is shown and described in Halliburton Services Sales and Service Catalog No. 40 at page 3490. The design of such packers is well known to those skilled in the art and generally includes a drag block means for engaging the casing of the well so as to provide an initial friction between the packer and the well. When the weight of the drill string is set down upon the packer means 46, the drag block means allows a set of slips to be set against the casing and then the same continuous downward motion serves to compress and expand a packer element to seal the annulus 40 between the test string 34 and the well casing 16. The actuating components of the packer means 46 includes a packer slot means (not shown) and a packer lug means (not shown) constructed similar to the lug means 152 and the slot means 154 shown in FIG. 3, i.e., the slot and lug means of the packer 46 are constructed the same as the slot and lug means of the drill pipe tester valve 62, so that the same setting down motion of the test string 34 which opens the spherical valve member 92 also sets the packer means 46.

When the well testing string 34 is picked up, the housing 66 is moved upward relative to the well casing 16 and accordingly the moving mandrel means 136 is moved downward relative to housing 66 to its said lower position thereby once again, closing spherical valve member 92.

Lower moving mandrel portion 140 includes an upper end 156 adapted for engagement with a lower end 158 of upper moving mandrel portion 138, so that when the weight of the test string 34 is set down upon housing 66, the lower moving mandrel portion 140 is moved upward relative to housing 66 and is engaged with upper moving mandrel portion 138 to move the upper moving mandrel portion 138 upward relative to housing 66, thereby opening spherical valve member 92.

The second section 146 or lower moving mandrel portion 140 includes an equalization port means 184 disposed through a wall thereof for communicating the flow passage 90 of housing 66 below spherical valve member 92 with the annulus 40 between the test string 34 and the well casing 16 when spherical valve member 92 is in its closed position. The annulus 40 may be generally described as a zone outside of housing 66.

Second section 144 of lower moving mandrel portion 140 further includes an outer cylindrical surface 186 closely received within an inner cylindrical surface 188 of a lower end of second valve casing portion 74 of housing 66.

An annular sealing means 190 is disposed between outer cylindrical surface 186 and inner cylindrical surface 188. Non-metallic backup rings 192 are provided on either side of the annular seals 190. The housing 66, lower moving mandrel portion 140, and annular seal means 190 are so arranged and constructed that when the weight of the test string 34 is set down upon housing 66, and the lower moving mandrel portion 140 is moved upward relative to housing 66, the equalization portion 184 is closed before the spherical valve member 92 is open.

Equalization port 184 also equalizes the pressure across the walls of moving mandrel 136 to prevent inward collapse thereof due to the hydrostatic head in annulus 40. It also prevents a hydraulic pressure lock from occurring between spherical valve member 92 and the formation tester valve 60 when the moving mandrel means 136 is telescoped into housing 66.

Upward movement of lower moving mandrel portion 140 relative to housing 66 is limited by engagement of an upward facing shoulder 194 of lower moving mandrel portion 140 with a downward facing shoulder 196 of housing 66, which combination of shoulders 194 and 196 may generally be described as a stop means for limiting upward movement of lower moving mandrel portion 140 relative to housing 66.

The automatic fill-up feature of drill pipe tester valve 62 is provided by a resilient coil compression spring 198 disposed about positioning mandrel 109 between a downward facing shoulder 200 of housing 66 and an upward facing shoulder 202 of upper valve seat holder 104.

The spring 198 provides an automatic fill-up feature for the drill pipe tester valve 62 so that as the well test string 34 is lowered into the well, well fluid from the well annulus 40 is allowed to flow upward through spherical valve member 92 when the pressure of the well fluid below spherical valve member 92 is sufficient to overcome the pressure of fluid above 92 plus the downward force exerted by spring 198. This features is more fully described below.

Upon initially starting to lower the well test string 34 into the well, the spherical valve member is held downward in its closed position with lower surface 132 of lower valve seat holder 106 in engagement with upper surface 134 of housing 66.

As the test string 34 is lowered lower into the well, the hydrostatic pressure of the well fluid in the well annulus 40 steadily increases until the force exerted upon the lower surface of valve member 92 by the pressure of the well fluid in the well annulus, which is communicated with the lower surface 100 through equalization port 184, becomes equal to the force exerted downward upon the upper surface 196 of valve member 92 by fluid in the flow passage 90 above valve member 92 plus the downward force exerted by spring 198. At that point, any further increase of the pressure of the well fluid in the annulus 40 as the test string 34 is further lowered causes the spherical valve member 92 to be moved axially upward relative to housing 66 thereby compressing spring 198.

This upward movement of spherical valve member 92 causes it to be rotated partially toward its fully open position, thereby cracking the valve open so that some of the well fluid from the annulus 40 is allowed to flow upward through the bore 94 of spherical valve member 92 into the flow passage 90 located above spherical valve member 92. Once the forces being exerted on spherical valve member 92 from below become less than the forces exerted on spherical valve member 92 from above, the compression spring 198 once again pushes spherical valve member 92 downward relative to casing 66 to its closed position as shown in FIG. 2B.

Thus, as the well string 34 is lowered into the well, periodically the pressure of the well fluid in the annulus 40 overcomes the pressure of the fluid above spherical valve member 92 in the flow passage 90 and overcomes the spring 198 and thereby "burps" the valve allowing a portion of well fluid to flow upward through the valve 92 thereby filling the string of pipe located above valve member 92 with well fluid. The spring 198 may, therefore, be said to be a means for automatically opening the spherical valve member 192 and allowing well fluid within the well to fill the string of pipe above spherical valve member 92 as the string of pipe is lowered into the well.

Whenever it is desired to pressure test a string of pipe located above spherical valve member 92, the lowering of the string of pipe is stopped and the spherical valve member 92 is soon moved downward to its closed position by the compression spring 198, if it indeed is not already in its downward closed position when the lowering is first stopped.

The string of pipe is pressure tested while the string of pipe is stopped and while the spherical valve member is in its closed position. This stopping is done periodically so that successive portions of the string of pipe are pressure tested periodically as the string of pipe is lowered into the well.

Thus, the spring 198 may be said to be a means for automatically closing the spherical valve member 92 when the string of pipe is statically positioned within the well. This permits the string of pipe located above spherical valve member 92 to be pressure tested.

Once the test string 34 is lowered into its final position within the well, the weight of the string of pipe is set down upon the housing 66 thereby moving the spherical valve member 92 upward relative to the housing 66 and rotating the spherical valve member 92 to an open position so that it does not interfere with the formation testing operation or with the lowering of wire line tools through the test string.

Also, the packer means 46 is provided below the drill pipe tester valve for sealing the annulus 40 between the test string 34 and the well casing 16, and the packer means 46 utilizes a J-slot and lugs similar to that of the drill pipe tester valve as shown in FIG. 3, so that when the weight of the test string 34 is set down upon the housing 66 to open the valve member 92, that same setting down motion also sets the packer means against the well casing.

Thus, it is seen that the Drill Pipe Tester Valve with Automatic Fill-up of the present invention readily achieves the ends and advantages mentioned as well as those inherent therein. While presently preferred embodiments of the invention have been illustrated for the purposes of this disclosure, numerous changes in the arrangement and construction of parts may be made by those skilled in the art, which changes are encompassed by the scope and spirit of this invention as defined by the appended claims.

What is claimed is:

1. A pipe tester valve, comprising:

spherical closure valve means having a valve bore therethrough and being rotatable between an open and a closed position for opening and closing an interior of a string of pipe; and automatic means for automatically closing said spherical closure valve means when said string of pipe is statically positioned within a well so that said string of pipe may be pressure tested, and for automatically opening said spherical closure valve means and allowing well fluid within said well to fill said string of pipe above said closure valve means as said string of pipe and closure valve means are lowered into said well, said spherical closure valve means being rotatable to its said open position when said string of pipe is finally positioned within said well.

2. The pipe tester valve of claim 1, wherein:

said pipe tester valve further includes a housing having an upper end adapted to be connected to said string of pipe having a flow passage disposed therethrough; and said spherical closure valve means is disposed in said flow passage of said housing, said flow passage being open and closed when said spherical closure valve means is in its open and closed positions, respectively.

3. The pipe tester valve of claim 2, further comprising:

lug means, connected to said housing, for engaging said spherical closure valve means and rotating said spherical closure valve means between its said open and said closed positions as said spherical closure valve means is moved axially relative to said housing between an upper position and a lower position, respectively.

4. The pipe tester valve of claim 3, wherein:

said automatic means includes spring means for resiliently urging said spherical closure valve means downward toward its closed position.

5. The pipe tester valve of claim 4, wherein:

said spring means includes a coil compression spring located above said spherical closure valve means.

6. The pipe tester valve of claim 5, wherein:

said coil compression spring is connected between said housing and an upper valve seat means of said spherical closure valve means.

7. The pipe tester valve of claim 1, wherein:

said automatic means includes spring means for resiliently urging said spherical closure valve means downward toward its closed position.

8. The pipe tester valve of claim 7, wherein:

said spring means includes a coil compression spring located above said spherical closure valve means.

9. An automatic filling pipe tester valve, comprising:

a housing having an upper end adapted to be connected to a string of pipe, and having a flow passage therethrough;

a spherical closure valve member disposed in said flow passage and being rotatable between an open and a closed position opening and closing said flow passage as said spherical closure valve member is moved axially relative to said housing between an upper and a lower position, respectively;

equalization means for communicating a pressure of a well fluid outside said housing with a lower surface of said spherical closure valve member when said spherical closure valve member is in its closed position; and spring means for resiliently urging said spherical closure valve member downward toward its said closed position, and for allowing said closure valve member to be moved upward by well fluid pressure exerted on said lower surface thereof as said string of pipe and tester valve are lowered into a well, so that said string of pipe above said tester valve is automatically filled with said well fluid as said string of pipe is lowered into the well.

10. The automatic filling pipe tester valve of claim 9, wherein:

said spring means includes a coil compression spring connected between said housing and an upper valve seat means against which an upper surface of said spherical closure valve member is sealingly engaged.

11. A pipe tester valve, comprising:

a housing having a first end adapted to be connected to a string of pipe, and having a flow passage therethrough;

a spherical valve member disposed in said flow passage of said housing, and having a valve bore therethrough, said spherical valve member being rotatable within said housing between an open position wherein said valve bore is in fluid communication with said flow passage of said housing and a closed position wherein said flow passage of said housing is closed by said spherical valve member;

lug means, connected to said housing, for engaging said spherical valve member and rotating said spherical valve member between its open and closed positions as said spherical valve member is moved axially relative to said housing and said lug means; and spring means for resiliently urging said spherical valve member in a first axial direction toward its said closed position, so that a fluid pressure exerted against said spherical valve member in a second axial direction opposite said first axial direction may be relieved by overcoming a force exerted by said spring means and moving said spherical valve member axially in said second direction toward its said open position.

12. The pipe tester of claim 11, wherein:

said first axial direction is further characterized as being a downward direction.

13. The pipe tester valve of claim 12, wherein:

said spring means includes a compression spring located above said spherical valve member.

14. The pipe tester valve of claim 13, wherein:

said compression spring is further characterized as being a coil spring.

15. The pipe tester valve of claim 13, wherein:

said compression spring is connected between said housing and an upper valve seat means.

16. The pipe tester valve of claim 15, wherein:

said upper valve seat means is attached to a lower end of a guide mandrel, said guide mandrel having an upper end closely received in an inner cylindrical surface of said housing; and said compression spring is further characterized as being a coil compression spring disposed around said guide mandrel.

17. The pipe tester valve of claim 11, further comprising:

means for communicating a well fluid under pressure outside said housing with a lower surface of said spherical valve member when said spherical valve member is in its said closed position; and wherein said spring means is further characterized as being a means for automatically filling said string of pipe above said tester valve with said well fluid as said string of pipe is lowered into said well.

18. The pipe tester valve of claim 17, wherein:

said spring means is further characterized as being a means for moving said spherical valve member to its said closed position when said string of pipe is statically positioned in said well so that said string of pipe may be pressure tested.

19. A method of pressure testing of string of pipe as said string of pipe is lowered into a well, said method comprising the steps of:

providing on a lower end of said string of pipe a tester valve including a spherical closure valve means having a valve bore therethrough;

urging said spherical closure valve means resiliently downward relative to a housing of said pipe tester valve by means of a resilient spring;

lowering said string of pipe into said well;

communicating a well fluid from outside said housing with a lower surface of said spherical closure valve means as said string of pipe is lowered into said well;

exerting sufficient well fluid pressure against said lower surface of said spherical closure valve means to overcome a downward force of said spring means and to move said spherical closure valve means upward relative to said housing;

rotating said spherical closure valve means to an open position as said spherical closure valve means is moved upward relative to said housing, thereby allowing said well fluid to automatically fill said string of pipe above said pipe tester valve as said string of pipe is lowered into said well;

stopping said lowering of said string of pipe periodically;

urging said spherical closure valve means downward by means of said resilient spring toward its closed position when said lowering of said string is stopped; and pressure testing said string of pipe while said lowering of said string of pipe is stopped so that successive portions of said string of pipe are pressure tested periodically as said string of pipe is lowered into said well.

* * * * *